US006082000A

United States Patent [19]

Fornasa

[11] Patent Number: 6,082,000

[45] Date of Patent: Jul. 4, 2000

[54] METHOD FOR PRODUCING AN IMPELLER FOR TURBINE PUMPS PROVIDED WITH VANES HAVING AN IMPROVED PROFILE

[75] Inventor: Diego Fornasa, Sarego, Italy

[73] Assignee: Dab Pumps S.p.A., Mestrino, Italy

[21] Appl. No.: 09/035,353

[22] Filed: Mar. 5, 1998

[30] Foreign Application Priority Data

Mar. 14, 1997 [IT] Italy ..... PD97A0050

[51] Int. Cl.[7] ..... B23P 15/00

[52] U.S. Cl. ..... 29/889.23; 29/889; 416/186 R; 416/DIG. 2

[58] Field of Search ..... 416/186 R, DIG. 2, 416/243, 165, 176, 177, 223 B; 29/889.23, 889, 889.2

[56] References Cited

U.S. PATENT DOCUMENTS

| | | | |
|---|---|---|---|
| 3,206,807 | 9/1965 | Hoffman et al. | 164/37 |
| 4,720,243 | 1/1988 | Katayama et al. | 416/186 R |
| 5,328,332 | 7/1994 | Chiang | 416/186 R |
| 5,438,755 | 8/1995 | Giberson | 29/889 |
| 5,573,374 | 11/1996 | Giberson | 416/186 R |
| 5,944,485 | 8/1999 | Maumus et al. | 416/186 R |

FOREIGN PATENT DOCUMENTS 0 061 375 9/1982 European Pat. Off. .

*Primary Examiner*—Edward K. Look
*Assistant Examiner*—Richard Woo
*Attorney, Agent, or Firm*—Guido Modiano; Albert Josif; Daniel O'Byrne

[57] ABSTRACT

A turbine pump impeller provided with vanes of the double-curvature type, obtained monolithically by die casting and comprising, between two disk-shaped elements, a plurality of double-curvature vanes. In each vane, the two surfaces that are struck by the fluid are obtained from a sequence of transverse curved portions formed by circular arcs centered on a common spatial central axis.

5 Claims, 5 Drawing Sheets

METHOD FOR PRODUCING AN IMPELLER FOR TURBINE PUMPS PROVIDED WITH VANES HAVING AN IMPROVED PROFILE

BACKGROUND OF THE INVENTION

The present invention relates to an a method for producing impeller for turbine pumps provided with vanes having an improved profile.

In particular, the impeller produced by the method according to the present invention is of the monolithic type obtained by casting a metal in a die. It is known that turbine pumps convert the mechanical energy that they receive from a motor into pressure energy of a fluid.

The basic part of the turbine pump is the impeller, which transfers the total energy to the unit of mass of the fluid that flows through it, partly as pressure energy and partly as kinetic energy.

The impeller of a turbine pump is substantially constituted by two elements which are substantially disk-shaped and between which the vanes are arranged; the vanes convey the fluid, which is drawn in at the axis of the turbine pump, to the scroll for connection to a user device.

The number of vanes of each impeller and their geometric and structural configuration depend on hydraulics and physics relations which are well-known and used by designers.

Twisting vanes, i.e., vanes of the double-curvature type, are frequently employed.

These impellers are currently obtained by introducing the molten metal, generally cast iron, in a die preset for this purpose, which in practice constitutes the complementary pattern from which the impellers take their shape. shape.

The die being used bears the impressions of the two disk-shaped elements and internally comprises a core suitable to shape the impressions of the fluid conveyance vanes.

The core is generally made of pressed and baked sand, is substantially toroidal and acts as a die body for the vanes.

In practical execution, it is necessary to start from the drawing of a theoretical design vane produced by a designer.

A modeler must then reproduce said theoretical vane in a real prototype, which is shown schematically in FIGS. 1 and 2 and designated by the reference letter A.

Once the modeler has created the vane prototype A, such prototype is used to form the pressed and baked sand core, designated by the reference letter B in the above figures.

Once the core B has been formed, production of the impeller continues by inserting the core in the die and by introducing the molten metal.

Moreover, the vane prototype A can currently be extracted from the core B only through the combination of a double movement which includes an outward translatory motion and a simultaneous lifting of the prototype, as shown schematically in FIGS. 1 and 2 by the arrows C and D.

The prototypes A of the vanes, by which the core B is shaped and which are obtained from a theoretical drawing, have a twisted shape; this causes great difficulty in production of vanes requires planing, filing, modifications and retouches of the structures of all the prototypes A.

In other words, the modeler has to retouch the first time each prototype A, performing a plurality of operations that remove material until the prototype can be extracted from the sand core B without risking damage to the core.

At the end of the adjustments, turbine pump impellers are obtained whose vanes have shapes which do not match the hydraulic theoretical models and which, in practical applications, reduce the hydraulic efficiency of the turbine machines.

The process for modifying and adapting the prototype A of each vane, in order to allow its easy extraction from the sand core B, usually requires a long time (which in any case cannot be estimated in advance) and entails significantly high costs, consequently constituting a burden for the first step of production.

Sometimes the modeler is forced to intervene more than once, starting each time from the very beginning, because he makes mistakes in planing and modifying the structure of the prototype A.

SUMMARY OF THE INVENTION

The aim of the present invention is to provide an impeller for turbine machines which has conveyance vanes whose shape eliminates the drawbacks noted above of conventional types.

Within the scope of this aim, a particular object of the present invention is to provide an impeller with vanes whose prototypes can be obtained without requiring particularly significant adjustments performed by removing material.

An important object of the present invention is to provide an impeller for turbine pumps obtainable at a lower cost than impellers obtained with conventional methods.

Another object of the present invention is to provide an impeller with double-curvature vanes which can be manufactured so as to reduce the time required by the first production step for creating the cores.

Another important object of the present invention is to provide an impeller with double-curvature vanes whose manufacture can allow a higher degree of automation than conventional impellers.

This aim, these objects and others which will become apparent hereinafter are achieved by an impeller which monolithically comprises, two disk-shaped elements between which, a plurality of double-curvature vanes are provided, characterized in that the surfaces of each vane are obtained from a sequence of transverse curved portions, said transverse portions being formed by circular arcs belonging to circles lying in different planes and centered on a common spatial central axis.

BRIEF DESCRIPTION OF THE DRAWINGS

Further characteristics and advantages of the impeller according to the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
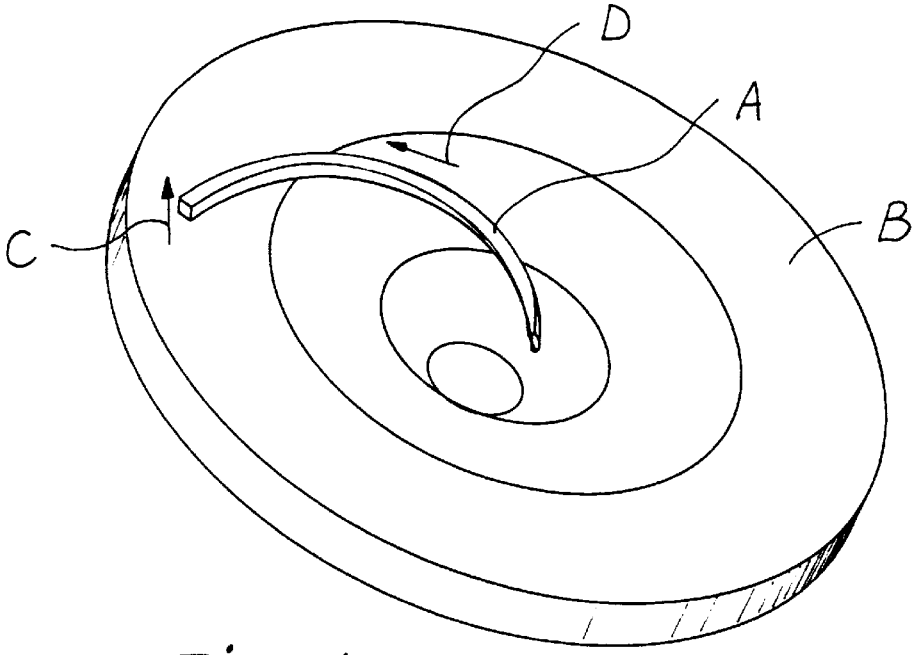
Fig. 1 PRIOR ART
FIGS. 1 and 2 are schematic perspective views of the state of the art, particularly of two steps for the extraction of a conventional prototype from a sand core.
Figure 2:
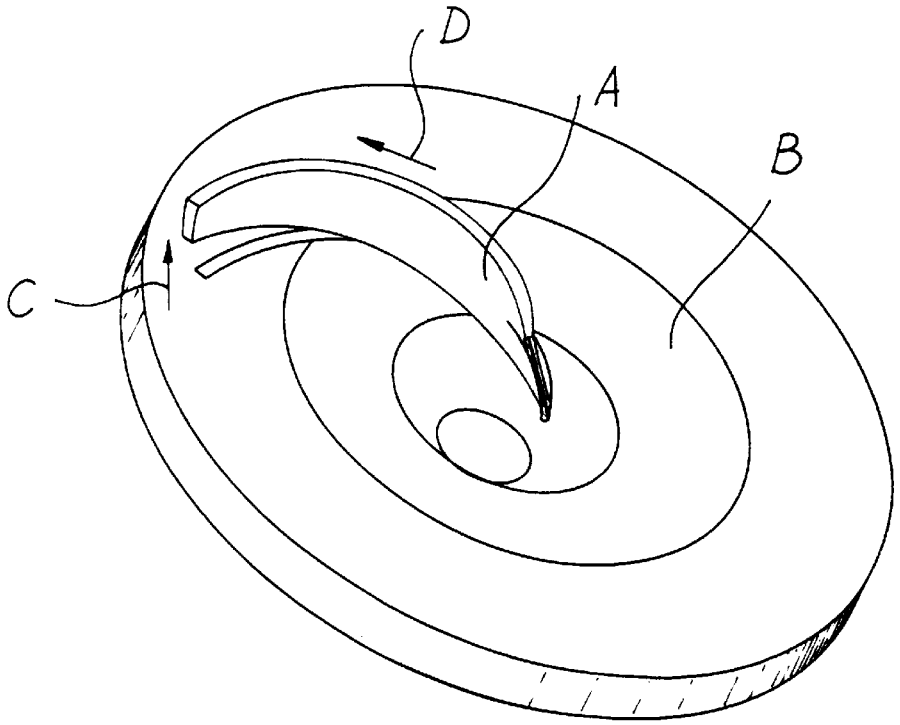
Fig. 2 PRIOR ART
Figure 3:
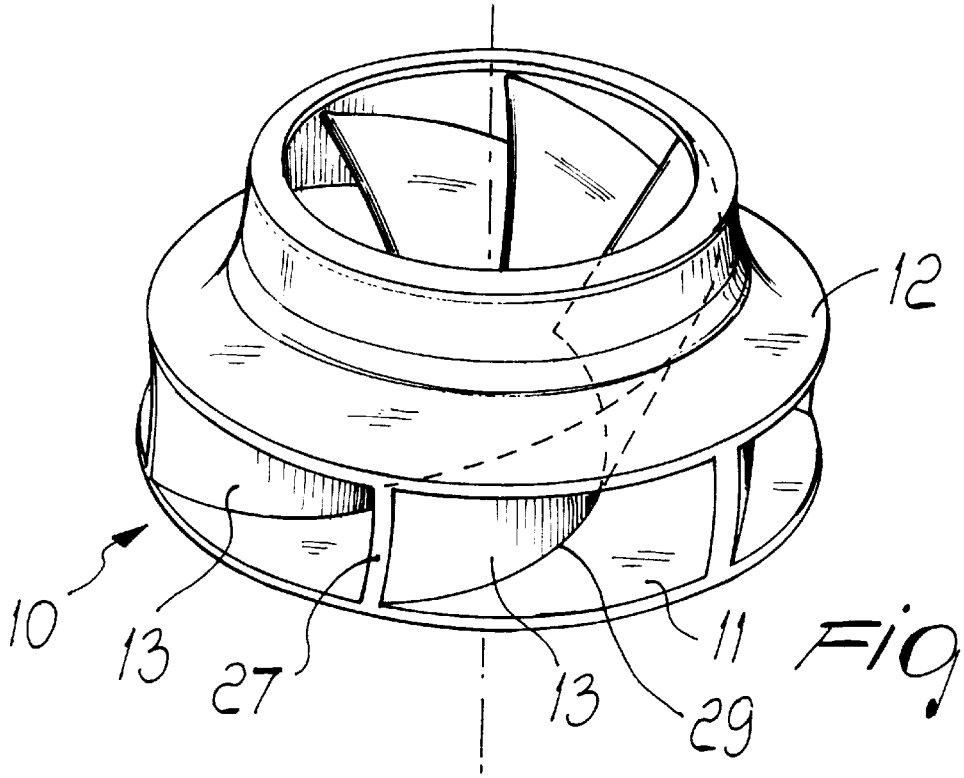
FIG. 3 is a perspective view of an impeller with vanes having an improved profile produced by the method according to the present invention.
Figure 4:
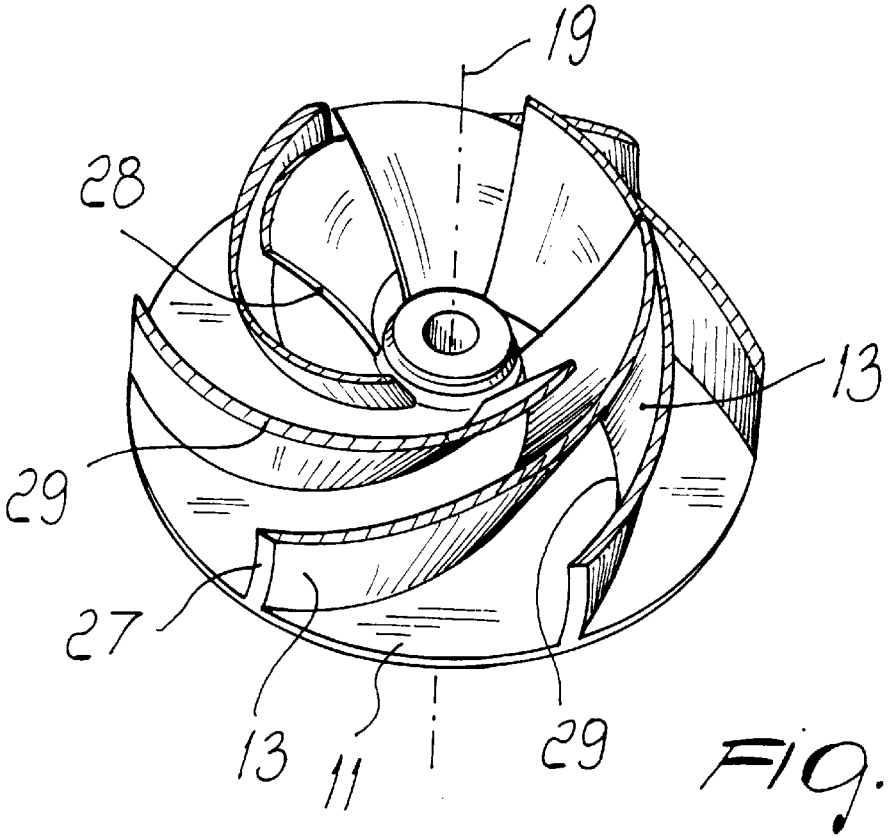
FIG. 4 is a perspective view of a detail of an impeller with vanes having an improved profile produced by the method according to the present invention.
Figure 5:
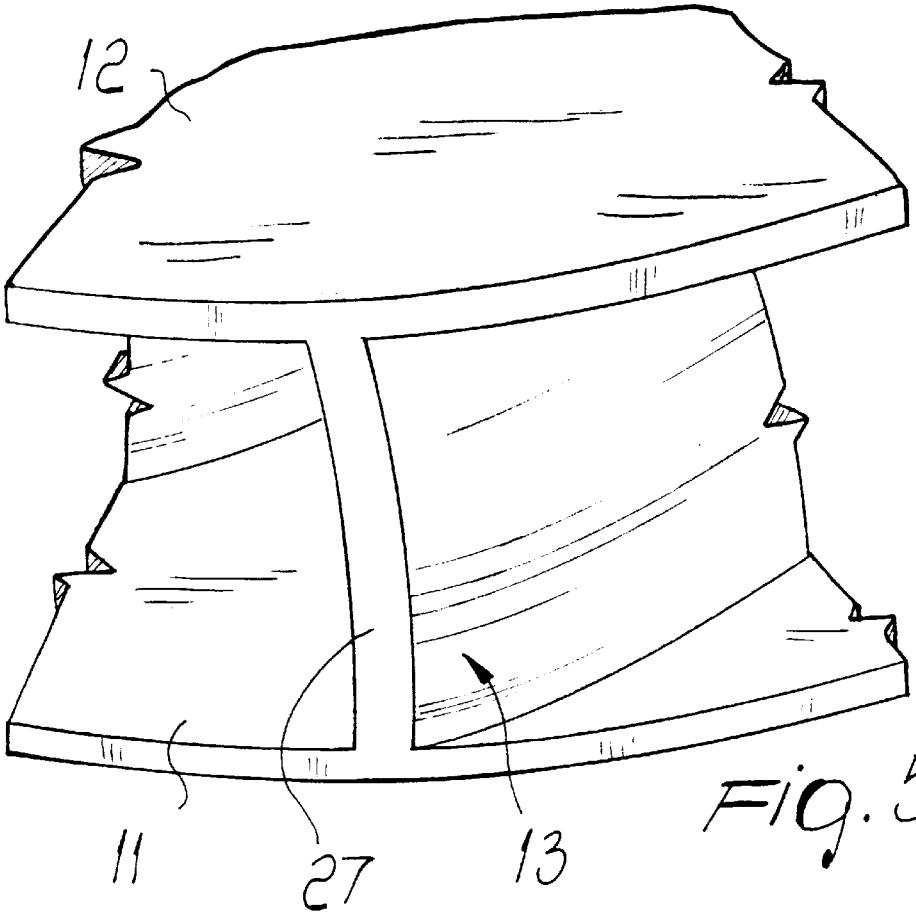
FIG. 5 is a perspective view of a detail of an impeller produced by the method according to the present invention.
Figure 6:
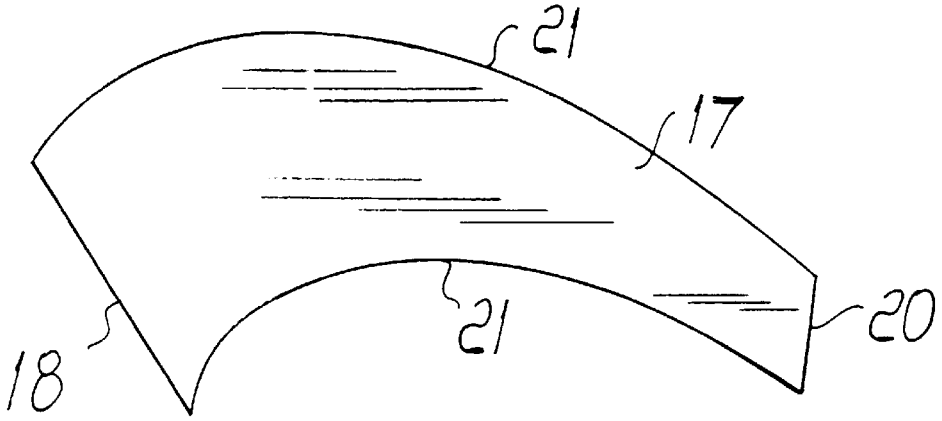
FIG. 6 is a view of a detail of a theoretical vane.
Figures 7, 8:
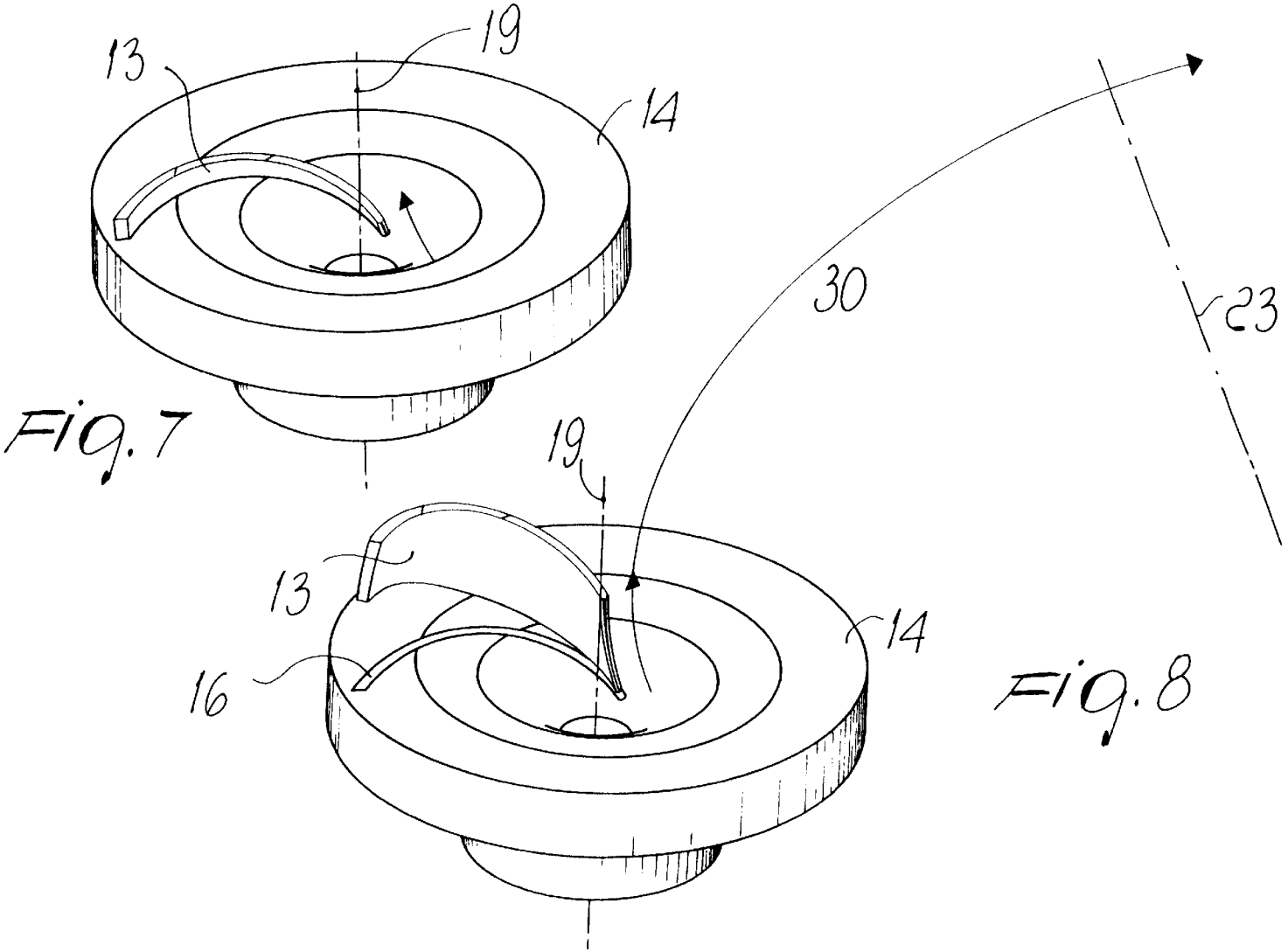
FIGS. 7 and 8 are schematic views of the step for extracting a prototype of a vane according to the present invention.
Figure 9:
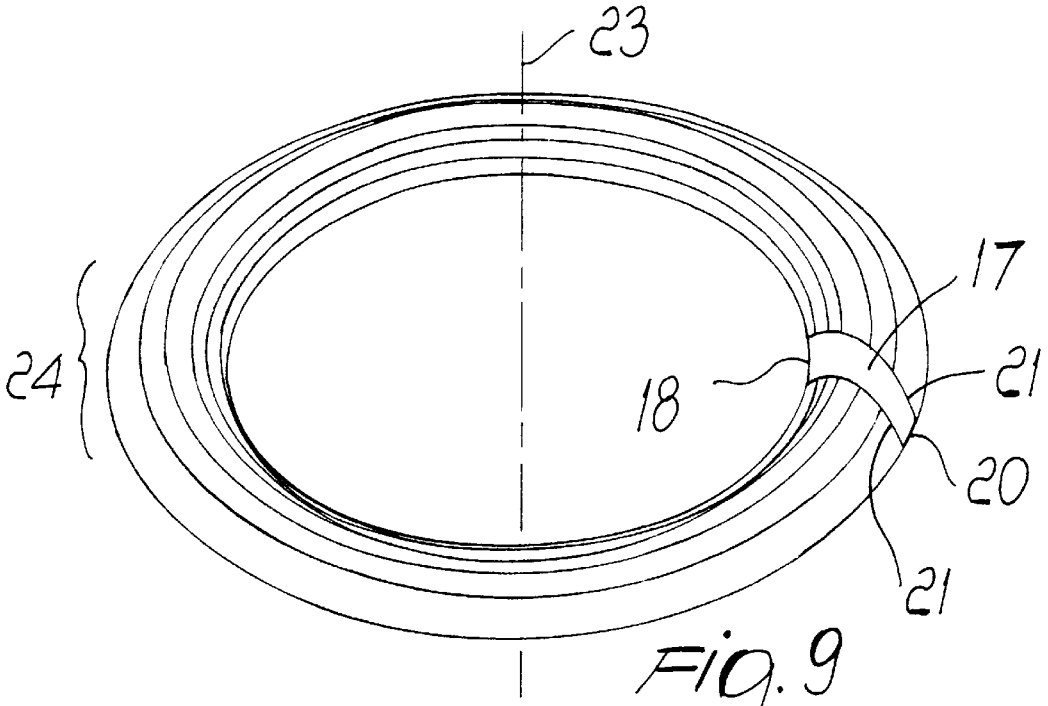
FIGS. 9 and 10 are schematic views of the step for the execution of a prototype of a vane according to the present invention.
Figure 10:
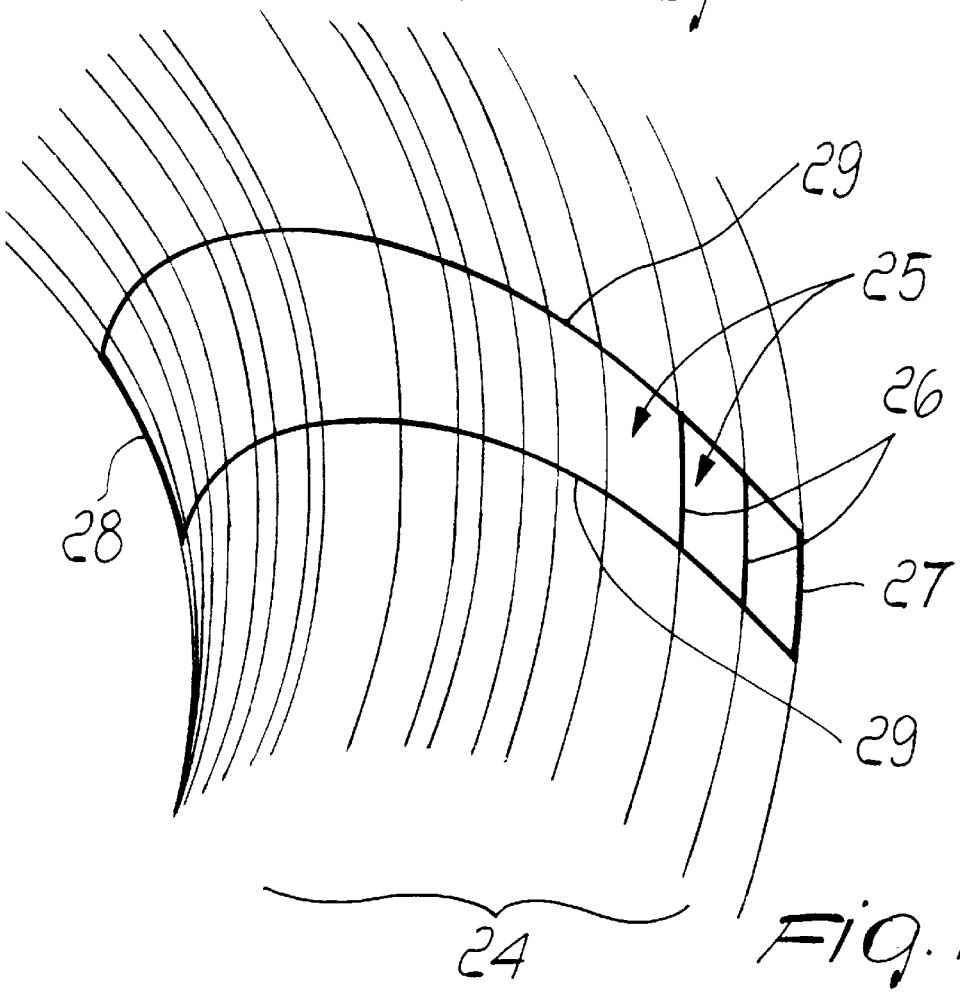

With particular reference to FIGS. 3 to 10, an impeller with vanes having an improved profile is generally designated by the reference numeral 10 and comprises, between a first element 11 and a second element 12, both substantially disk-shaped, a plurality of vanes 13 of the double-curvature type.

The impeller 10, according to the invention, is formed monolithically, in a per se known manner, by casting metal, usually cast iron, which is cast into a suitably complementarily shaped die (not shown in the above described figures) which contains a core 14 forming the impressions of the vanes 13.

The core 14 has a toroidal structure on which there are provided impressions 16 shaped complenentarily to the vanes 13 of the impeller 10.

In practical execution, one starts from a theoretical vane 17 which is the result of three-dimensional computer-aided design simulations, is of the double-curvature type, is obtained according to per se known hydraulic relations and has no thickness.

On the theoretical vane 17 it is possible to easily locate development curves 21, determined by joining the impeller 10 with the disk-shaped elements 11 and 12; an internal intake profile 18, adjacent to the central axis 19 of the impeller 10; and an external delivery profile 20.

Continuing with the three-dimensional design simulation, starting from the theoretical vane 17, an axis 23 substantially inclined with respect to the set of theoretical vanes 17 of the impeller 10 is located by trial and error in space.

The axis 23 is obtained from a sequence of points which are the centers of circles generally designated by the reference numeral 24.

The circles 24 are unequivocally determined by points that belong to the inner profile 18 and to the outer profile 20 of each theoretical vane 17.

The circles 24 form a sequence of curved portions 25, each whereof is delimited by arcs 26 lying on the circles 24.

The result of the sequence of the curved portions 25, substantially delimited by the development curves 21 of the theoretical vane 17, is the vane 13 of the impeller 10, which has an inner profile 28 and an outer profile 27 which are shaped respectively like arcs formed by two of the circles 24.

The inner profile 28 is therefore shaped like an arc of a circle centered on the axis 23 and so that the concavity, in this embodiment, is actually arranged in the opposite direction with respect to the concavity of the arc of the outer profile 27.

Accordingly, starting from the theoretical double-curvature vane 17, a vane 13 is obtained whose development curves 29 (which correspond to development curves 21 of the theoretical vane 17) are substantially unchanged with respect to the corresponding curves 21, since the vane 13 is obtained as a sequence of the portions 25 delimited by the arcs 26 of the circles 24 centered on the axis 23.

The improved vane 13 can be used to obtain, practically without any subsequent correction or adjustment, the core 14 to be placed in the die to cast the impeller 10.

The resulting core 14 in fact allows to extract the vanes 13 from the impressions 16 in a single direction, designated by the reference numeral 30, corresponding to an arc of one of the circles 24 centered on the axis 23.

In practice, it has been found that the present invention effectively achieves the intended aim and all the objects.

In particular, an important advantage is achieved with the present invention in that an impeller with vanes having an improved profile has been provided which can be obtained without any modification and without requiring adjustments produced by removing material.

Another advantage is ensured with the present invention in that an impeller having improved vanes has been provided which can be manufactured at extremely competitive production costs with respect to impellers obtained with conventional methods.

Another important advantage is achieved with the present invention in that a turbine pump impeller provided with double-curvature vanes has been provided which can be produced in a very short time and within preset time limits with respect to conventional impellers.

An important advantage is achieved with the present invention in that a turbine pump impeller with vanes having an improved profile has been provided which can be produced according to an entirely automated process.

The present invention is subjected to numerous modifications and variations, all of which are within the scope of the same inventive concept.

Moreover, all the details may be replaced with other technically equivalent elements.

The materials employed, as well as the dimensions, may be any according to requirements.

What is claimed is:

1. A method for producing an impeller (10) which monolithically comprises two disk-shaped elements (11,12) between which a plurality of double-curvature vanes (13) are provided, the method comprising:

obtaining surfaces of each vane by a sequence of transverse curved portions (25) formed by circular arcs belonging to circles (24) lying in different planes and centered on a common spatial central axis (23);

forming a core (14) with impressions (16) shaped complementarily to the vanes; and casting in a die containing said core and producing said impeller (10) with said double-curvature vanes (13).

2. The method according to claim 1, wherein the step of obtaining surfaces of each vane comprises forming a set of theoretical double-curvature vanes (17) each having an internal intake profile (18) and an external delivery profile (20) and development curves (21) extending between the intake and delivery profiles.

3. The method according to claim 2, comprising determining said circles by means of points that belong to said intake profile and said delivery profile of each of said theoretical double-curvature vanes.

4. The method according to claim 3, comprising extracting the double-curvature vanes (13) from said impressions (16) of said core (14) in a single direction (30) corresponding to an arc of one of said circles (24) centered on said axis (23).

5. The method according to claim 1, comprising extracting the double-curvature vanes (13) from said impressions (16) of said core (14) in a single direction (30) corresponding to an arc of one of said circles (24) centered on said axis (23).

* * * * *